US008530774B2

(12) United States Patent
Grieshaber et al.

(10) Patent No.: US 8,530,774 B2
(45) Date of Patent: Sep. 10, 2013

(54) HIGH VOLTAGE CIRCUIT BREAKER WITH IMPROVED GAS EXHAUST

(75) Inventors: Wolfgang Grieshaber, Lyons (FR); Roger Ledru, Tignieu (FR); Steven Grosick, Stockdale, PA (US); Nicklas Davison, West Newton, PA (US)

(73) Assignee: Areva T&D SA, Paris la Defense (FR)

( * ) Notice: Subject to any disclaimer, the term of this patent is extended or adjusted under 35 U.S.C. 154(b) by 858 days.

(21) Appl. No.: 12/270,746

(22) Filed: Nov. 13, 2008

(65) Prior Publication Data

US 2009/0134123 A1 May 28, 2009

(30) Foreign Application Priority Data

Nov. 22, 2007 (FR) ..... 07 59228

(51) Int. Cl.
*H01H 33/91* (2006.01)

(52) U.S. Cl.
USPC ..... 218/51; 218/59

(58) Field of Classification Search
USPC ..... 218/13, 43–47, 51–57, 59–64, 67–73, 218/76–80
See application file for complete search history.

(56) References Cited

U.S. PATENT DOCUMENTS

| | | | | |
|---|---|---|---|---|
| 4,236,053 | A | 11/1980 | Sasaki et al. | |
| 5,717,183 | A | 2/1998 | Lehmann et al. | |
| 6,489,581 | B2 * | 12/2002 | Ozil et al. | 218/61 |
| 6,646,850 | B1 | 11/2003 | Bergmann et al. | |
| 2007/0068904 | A1 | 3/2007 | Dahlquist et al. | |

FOREIGN PATENT DOCUMENTS

| | | | |
|---|---|---|---|
| DE | 2947957 | A1 | 4/1980 |
| DE | 9314779.1 | | 11/1993 |
| EP | 1185996 | B1 | 9/2003 |
| EP | 1768150 | A1 | 3/2007 |
| EP | 1806760 | A1 | 7/2007 |
| JP | 2003-217411 | A | 7/2003 |

OTHER PUBLICATIONS

French Preliminary Search Report dated Jul. 30, 2008 for FR 0759228.

* cited by examiner

*Primary Examiner* — Tulsidas C Patel
*Assistant Examiner* — Marina Fishman
(74) *Attorney, Agent, or Firm* — Nixon Peabody LLP

(57) ABSTRACT

A method of evacuating hot gases produced in a current breaking operation by a high voltage circuit breaker (1) which comprises a metal outer tank (2) filled with insulating gas, a casing (3) having gas outlet ports (30) and arranged inside the metal outer tank (2), with which it is in communication via the said ports, characterized in that insulating gas (GI) is aspirated from inside the casing (3) in a direction parallel to the flow of the hot gases (GC) produced by the current breaking operation, so as to mix the gases inside the casing (3) before they are evacuated, through the said gas outlet ports (30) of the casing, into the interior of the metal outer tank (2). The invention also relates to an associated high voltage circuit breaker, which includes means (5) for aspirating insulating gas from the interior of the casing (3), in a direction parallel to the hot gas stream.

10 Claims, 5 Drawing Sheets

HIGH VOLTAGE CIRCUIT BREAKER WITH IMPROVED GAS EXHAUST

CROSS REFERENCE TO RELATED APPLICATIONS OR PRIORITY CLAIM

This application claims priority to French Patent Application No. 07 59228, filed Nov. 22, 2007.

TECHNICAL FIELD AND PRIOR ART

This invention relates to the field of high voltage circuit breakers, having a metal outer tank and being either of the gas insulated switchgear (GIS) or of the dead tank type. Such circuit breakers may be part of a metalclad switch.

More particularly, the invention relates to a method of evacuating hot gases produced in a current-breaking operation by such a circuit breaker, and to the structure of the circuit breaker itself.

In this type of circuit breaker, for certain values of short-circuit current that correspond to a maximum fault current, the hot gases (that is to say the plasma and exhaust gases) that are generated can lead to restriking between the various high voltage current breaking components and the components connected to ground, such as the metal outer tank.

In metalclad circuit breakers available commercially at the present time, various kinds of evacuation or exhaust systems are provided.

A first type of system, which is for example to be found in Japanese types of circuit breaker, such as the system described in Patent Application JP 2003 217411, includes a short tube fitted at the outlet of the hot gas blow-out nozzle, this tube also permitting the gas to be blown directly into the metal outer tank. Dielectric insulation is obtained by keeping long distances between the evacuation crown, constituted by the tube and the metal outer tank.

A second type of system, which is for example provided in "dead tank" switches such as published Patent Application EP 1 806 760, makes it possible to have present in the metal part of the exhaust a volume of dielectric gas that is large enough to absorb all the hot gases generated during the longest arcing period of the maximum short-circuit current. This exhaust arrangement includes lateral ports on the side through which the hot gases escape into the interior of the metal outer tank.

The first above-described type contains volumes of insulating gas that are by construction smaller than the quantity of hot gases blown out during a current breaking operation. That is why the metal outer tank has overall dimensions that are larger than in the second type, due to the fact that the hot gases are evacuated in a controlled way, and consequently dimensional safety margins are needed in order to ensure that the outer tank has the necessary dielectric strength.

The closing operation performed in the system of the second type involves a large enough volume to conserve the hot gases inside the metal part of the exhaust. In addition, the dimensional safety margin between the outside of the exhaust and the metal outer tank can be reduced.

Documents U.S. Pat. No. 4,236,053, DE 9 314 779, and DE 2 947 957, teach means for cooling the hot gases by passing them through heat exchangers including solids. Heat exchanges are limited to the single exposed surface of the components and necessarily take time to perform their function.

Finally, the document EP 1 185 996 B1 teaches an exhaust structure with means arranged in alternation for varying the section through which the stream of hot gases passes in the exhaust path, and accordingly for cooling the gas stream before it leaves via the longitudinal end of the contact tube surrounding the fixed arcing contact.

It is not recommended to use the variations in section described in that document if satisfactory purging of the current-breaking gases between the arcing contacts is to be obtained.

An object of the invention is to reduce further the overall dimensions for the exhaust or evacuation of the hot gases, and also to reduce further the dimensions of the metal outer tank.

Another object of the invention is to propose a way of evacuating the hot gases that gives satisfactory cooling while maintaining satisfactory purging of the current-breaking gases between the arcing contacts.

DISCLOSURE OF THE INVENTION

To that end, the invention provides a method of evacuating hot gases produced in a current breaking operation by a high voltage circuit breaker which comprises a metal outer tank filled with insulating gas, a casing having gas outlet ports and arranged inside the metal outer tank, with which it is in communication via the said ports.

According to the invention, insulating gas is aspirated from inside the casing in a direction parallel to the flow of the hot gases produced by the current breaking operation, so as to mix the gases inside the casing before they are evacuated, through the said gas outlet ports of the casing, into the interior of the metal outer tank.

In the invention, therefore, use is made of the insulating gas that is present in the exhaust structure of the circuit breaker before the current is broken, this gas being by definition colder than the hot gases that are given off by the current breaking operation, and this colder gas is mixed with the said hot gases before they are exhausted into the interior of the outer tank. In the circuit breaker structures of the prior art, the cold insulating gas that is already present in the exhaust is merely pushed towards the interior of the metal outer tank by the hot gases, which therefore do not undergo any cooling by mixing with the insulating gas.

The invention has particular relevance in relation to maximum fault currents, with the longest arcing times.

The invention also provides to a high voltage circuit breaker that is, in particular, adapted to perform the method of the invention.

According to the invention, such a circuit breaker comprises:

a metal outer tank filled with an insulating gas;

a casing having gas outlet ports, the casing being arranged inside the metal outer tank, with which it is in communication via the ports;

a pair of arcing contacts, at least one of which is movable in straight line motion along an axis and which is fixed to an insulating nozzle for blowing out hot gases generated in the separating of the contacts; and means for aspirating insulating gas from inside the casing, in a direction parallel to the flow of hot gases blown out in the separating of the contacts, whereby to mix the gases inside the casing before they are evacuated, through the gas outlet ports of the casing, into the interior of the metal outer tank.

In one embodiment of the invention, the circuit breaker comprises, as the means for aspirating insulating gas:

a sheath surrounding the fixed contact and arranged inside the casing to define an open passage; and at least one deflector element arranged inside the sheath and being such that the hot gases aspirate insulating gas from the open passage, with the or each deflector diverting the aspirated insulating gas in a direction parallel to the hot gas flow, and the insulating gas thus aspirated and diverted mixing with the hot gases inside the casing.

The or each deflector so provided within the framework of the invention therefore forces the insulating gas aspirated from the open-ended passage to be completely deflected, and to be caused to flow parallel to the stream of hot gases generated by the blowing-out operation, before they are subsequently mixed inside the casing, to leave via the ports provided.

In an advantageous modified version, the gas outlet ports are formed at one of the longitudinal ends of the casing.

The open passage may have a plurality of holes spaced apart uniformly at the periphery of the sheath. In this version, where the gas outlet ports are formed at the periphery of the casing, the hot gases leaving the nozzle that is blowing gas out at high velocity are able to aspirate the colder insulating gas from the outer part of the exhaust (that is to say the part lying between the sheath and the casing), and through the gas return portion of the passage (that is to say from the base to the ports), and through the open holes.

In one advantageous embodiment, there are provided two deflectors that are coaxial on the axis of the straight line motion of the movable contact, one of the two deflectors having at least one notch formed at one of its longitudinal ends, and the said casing, sheath, and two deflectors together defining a baffle for directing insulating gas through the said notch.

In one embodiment, one of the two arcing contacts is fixed to the casing, and the other one is movable in straight line motion along the said axis.

Alternatively, both arcing contacts are movable in straight line motion along an axis.

Finally, the invention provides to a circuit breaker module of the kind set forth above, which comprises the casing, the sheath and the deflectors.

According to the invention, this module may be made from five metal components that are assembled together and that consist of:

two cast members, of which:

one cast member is a cover member in which the gas outlet ports are formed; and the other cast member comprises a body portion to which the fixed arcing contact can be fixed, and which defines one part of the sheath and one of the two deflectors, the body portion further including a portion in which the insulating nozzle can slide; and three tubular members constituting, respectively, the casing, the remaining part of the sheath, and the other deflector, each of the said tubular members being made from rolled metal sheet.

The module of the invention may also be made from six metal components that are assembled together and that consist of:

three cast members, of which:

one cast member is a cover member in which the gas outlet ports are formed;

a further cast member defines a portion of the sheath and a portion of one of the two deflectors, the said further cast member comprising a body portion on which the fixed arcing contact may be secured; and a final said cast member, which includes the remaining portion of the said one deflector, in which the insulating nozzle is able to slide; and three tubular members constituting, respectively, the casing, a part of the sheath, and the other part of the sheath, each of the said tubular members being made from rolled metal sheet.

Such modules, for performing the method of the invention have the advantage of reduced manufacturing cost, which results in particular from the reduction in casting of components and from the fact that assembly of the various parts is simplified.

The module consisting of six metal parts has the advantage of simplified castings.

BRIEF DESCRIPTION OF THE DRAWINGS

Further advantages and features appear more clearly from a reading of the following detailed description, which is made with reference to the attached drawings, in which.

DETAILED DESCRIPTION OF PARTICULAR EMBODIMENTS

Figure 1:
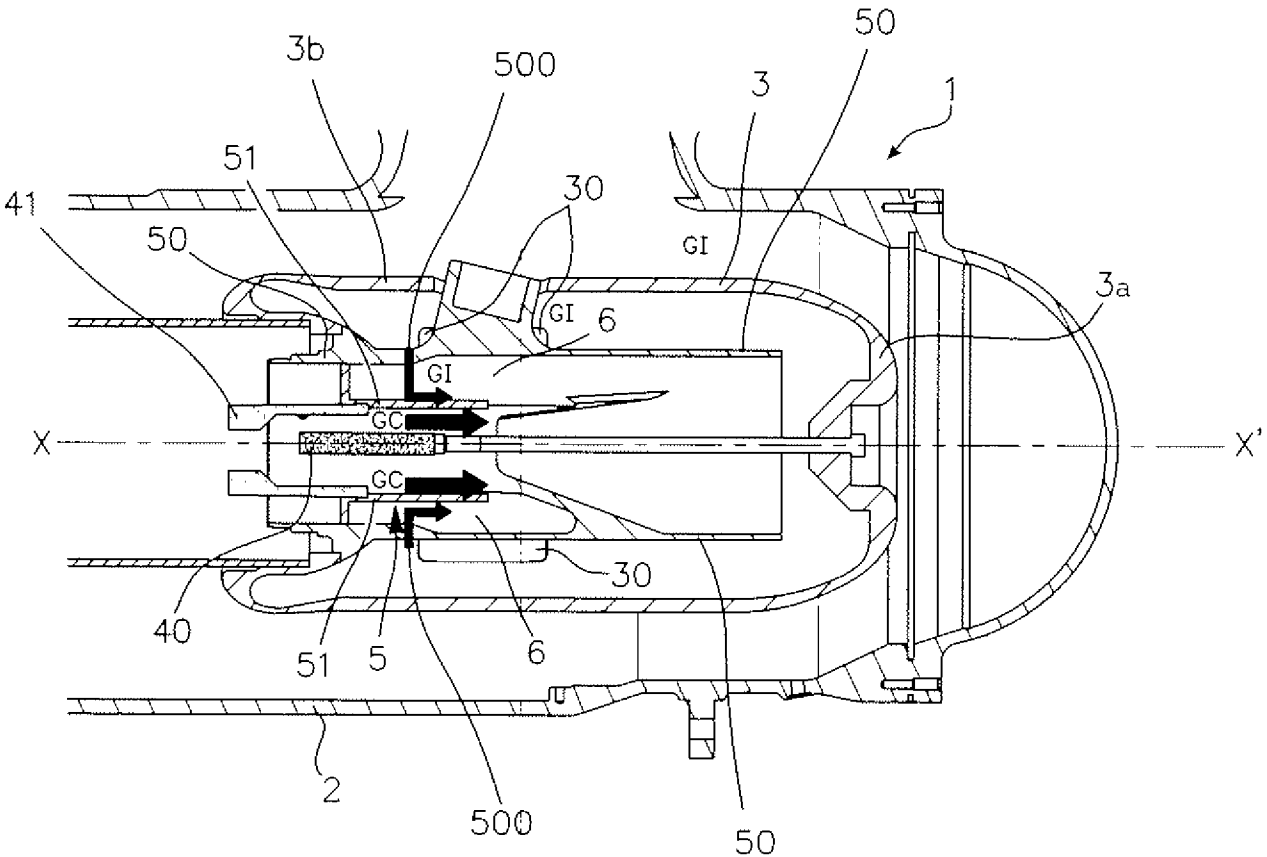
FIG. 1 is a diagrammatic view in longitudinal section showing a circuit breaker in one embodiment of the invention.

FIG. 1 is a view, seen in longitudinal section, of a metalclad (gas insulated switchgear or GIS) circuit breaker. This high voltage circuit breaker includes a metal outer tank 2 filled with an insulating gas GI, and a casing 3 that has gas outlet ports 30. The casing is arranged in the interior of the metal outer tank, with which it is in communication through the gas outlet ports for the purpose of evacuating insulating gases GI or hot gases GC, as represented by the respective arrows. More precisely, in the embodiment of FIG. 1, the gas outlet ports are formed at the periphery of the casing 3 close to its longitudinal end 3*b*, which is the end nearest to the current breaking zone.

The circuit breaker 1 also includes a pair of arcing contacts, of which only the fixed contact 40 is shown in FIG. 1, this contact being fixed to the casing 3. The other contact, which is movable in straight line motion along the axis XX', is fixed to an insulating nozzle 41, the purpose of which is to blow out the hot gases which are generated as the contacts move apart.

In accordance with the invention, means are provided for aspirating insulating gas GI from the interior of the casing 3, in a direction parallel to the stream of hot gases CC blown out as the contacts are separated, so that the gases GI and GC are mixed together inside the casing before being evacuated, through the gas outlet ports in the casing 3, into the interior of the metal outer tank 2.

In the embodiment of FIG. 1, the aspirating means, 5, comprise a sheath 50 surrounding the fixed contact 40, the sheath being arranged inside the casing 3 to define a passage 6 which is open through a plurality of through holes 500 that are spaced uniformly around the periphery of the sheath 50. The aspirating means also include a single deflector in the form of a tubular portion 51, arranged inside the sheath in such a way that the hot gases GC aspirate gas GI from the holes 500, that is to say exclusively from the interior of the casing 3, and the deflector 51 diverts the insulating gas GI in a direction parallel to the stream of hot gases. The arrangement of the deflector 51 in the sheath 50 is therefore such that only the insulating gas GI originating in the interior of the casing 3 is aspirated, and not, for example, the gases at the periphery of the nozzle 41. The aspirated and diverted insulating gas is then mixed with the hot gas in the interior of the casing 3.

Thus, in the embodiment shown in FIG. 1, the hot gases GC leaving the nozzle 41 at a high velocity are able to aspirate the cooler insulating gas from the outer part of the exhaust (that is to say the part lying between the sheath 50 and casing 3), through a part of the gas return passage (that is to say from the closed end 3*a* towards the lateral openings), and then through the through holes 500.

Figures 2, 2A, 2B, 2C, 2D:
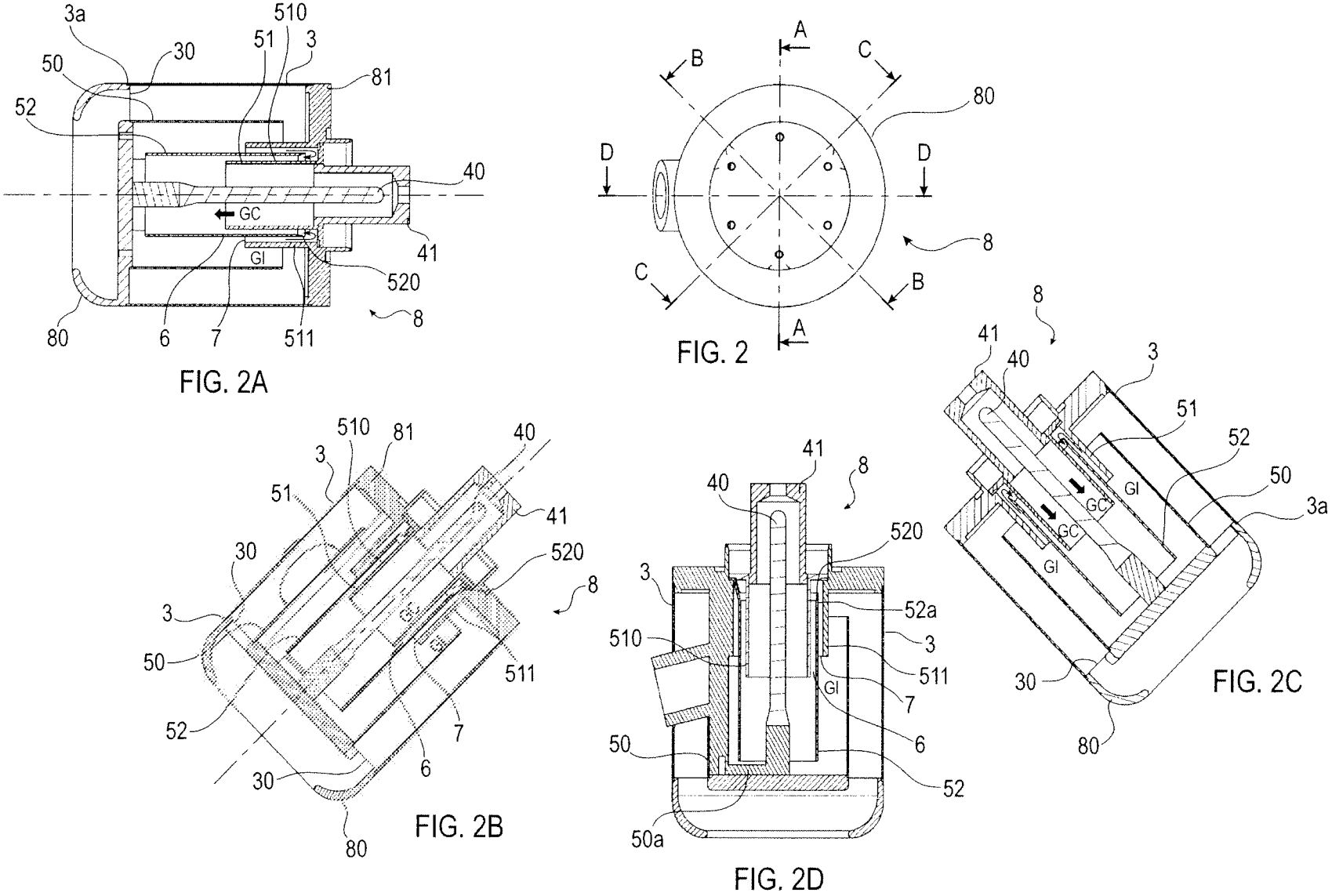
FIG. 2 is a front view of a circuit breaker module in an advantageous embodiment of the invention.
FIGS. 2A, 2B, 2C and 2D are views in longitudinal section taken on the planes AA, BB, CC and DD respectively in FIG. 2.
Figure 3F:
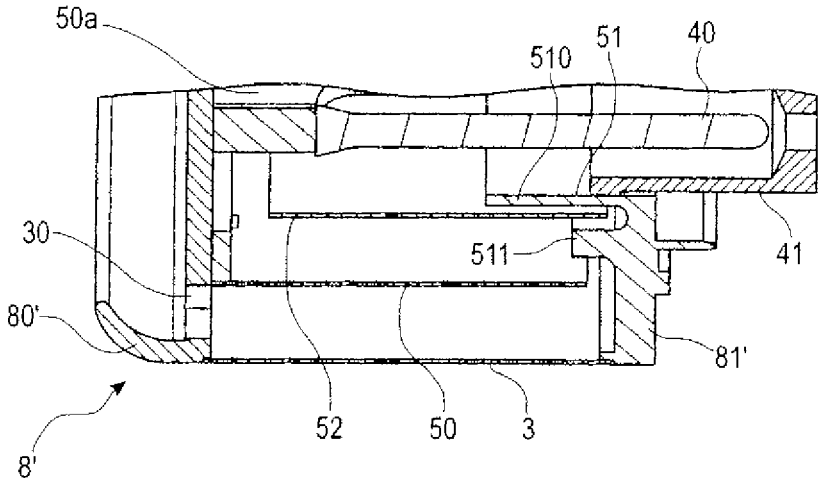
FIG. 3F is a scrap view in longitudinal section taken on the plane FF in FIG. 3.
Figure 3:
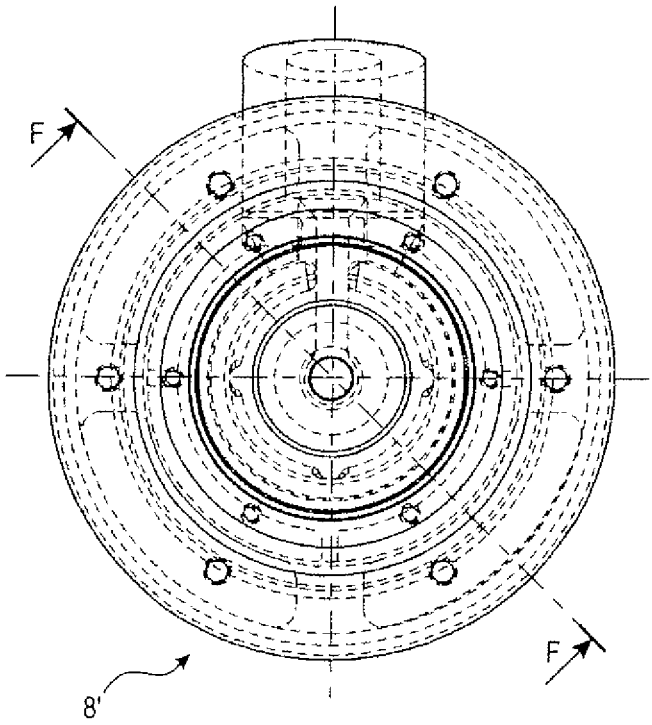
FIG. 3 is a front view of a circuit breaker module in another advantageous embodiment of the invention.

In the embodiment of FIGS. 2 to 2D, and in that shown in FIGS. 3 to 3F, the gas outlet ports are formed at one of the longitudinal ends, 3*a*, of the casing 3, and the aspirating means include two deflectors 51 and 52, which are coaxial relative to the axis XX' along which the straight movement of the movable contact and nozzle 41 takes place, with one of the two deflectors, 52, having a plurality of notches 520 formed at one of its longitudinal ends 52*a*, and the arrangement of the casing, and sheath with the two deflectors 51 and 52 defines a baffle 7 for guiding insulating gas through the notches 520 (see the curved arrows in FIGS. 2A and 2C for example).

More precisely, in the two embodiments shown, one of the two deflectors, the deflector 51, consists of two wall portions 510 and 511 parallel to each other. The other deflector 52 is arranged between these two parallel wall portions 510 and 511, in such a way that the baffle for guiding insulating gas, or aspiration baffle 7, is configured in the form of a Z with the interior of the sheath 50 parallel to the wall portion 511 (see for example FIG. 2A).

In the embodiment shown in FIGS. 2A to 2D, the module 8 of the invention is made from six metal parts, telescoped and screwed together. Three of the six parts are castings. One of these is a cover member 80, in which the gas outlet ports 30 are formed. A further cast part 81 constitutes one part of the sheath 50, and has a body portion 50*a*, to which the fixed arcing contact may be secured, and a portion 511 of one of the deflectors, namely the deflector 51. The final cast component comprises another portion 510 of the deflector 51 in which the nozzle 41 is arranged to slide. Finally, three tubular members are, respectively, the casing 3, the other part of the sheath 50 and the other deflector 52, each of which is made in rolled sheet metal.

Figure 3A:
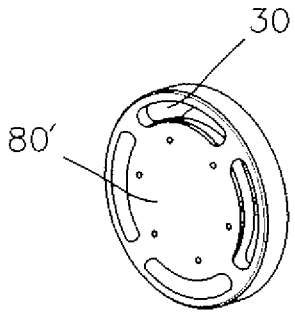
FIGS. 3A to 3E are perspective views which show various components of the embodiment shown in FIG. 3.
Figure 3B:
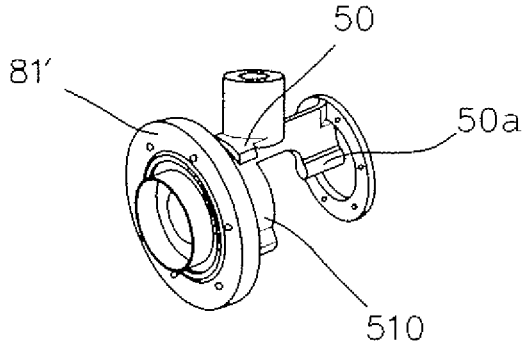
Figure 3C:
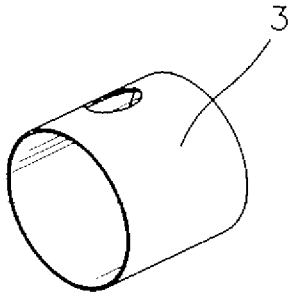
Figure 3D:
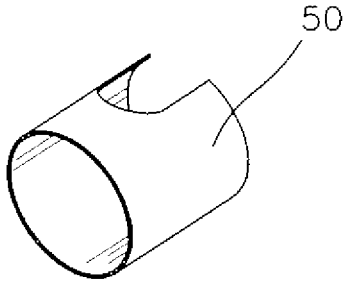
Figure 3E:
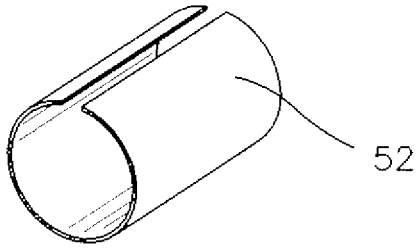

In the embodiment shown in FIGS. 3 to 3F, the module 8' of the invention is made from five metal components that are telescoped and screwed together. Two of these are castings (FIG. 3A and FIG. 3B). One of the castings is a cover member 80' in which the gas outlet ports 30 are formed. The other cast member 81' defines a portion of the sheath 50, with a body portion 50*a* to which the fixed arcing contact 40 may be secured. The member 81' includes, integral with it, one of the deflectors, namely the deflector 51, in a portion 510 of which the insulating nozzle is able to slide. Finally, three tubular members consist, respectively, of the casing 3 (FIG. 3C), the other portion of the sheath 50 (FIG. 3D), and the other deflector 52 (FIG. 3E), each of which is made from rolled sheet metal.

Figure 4:
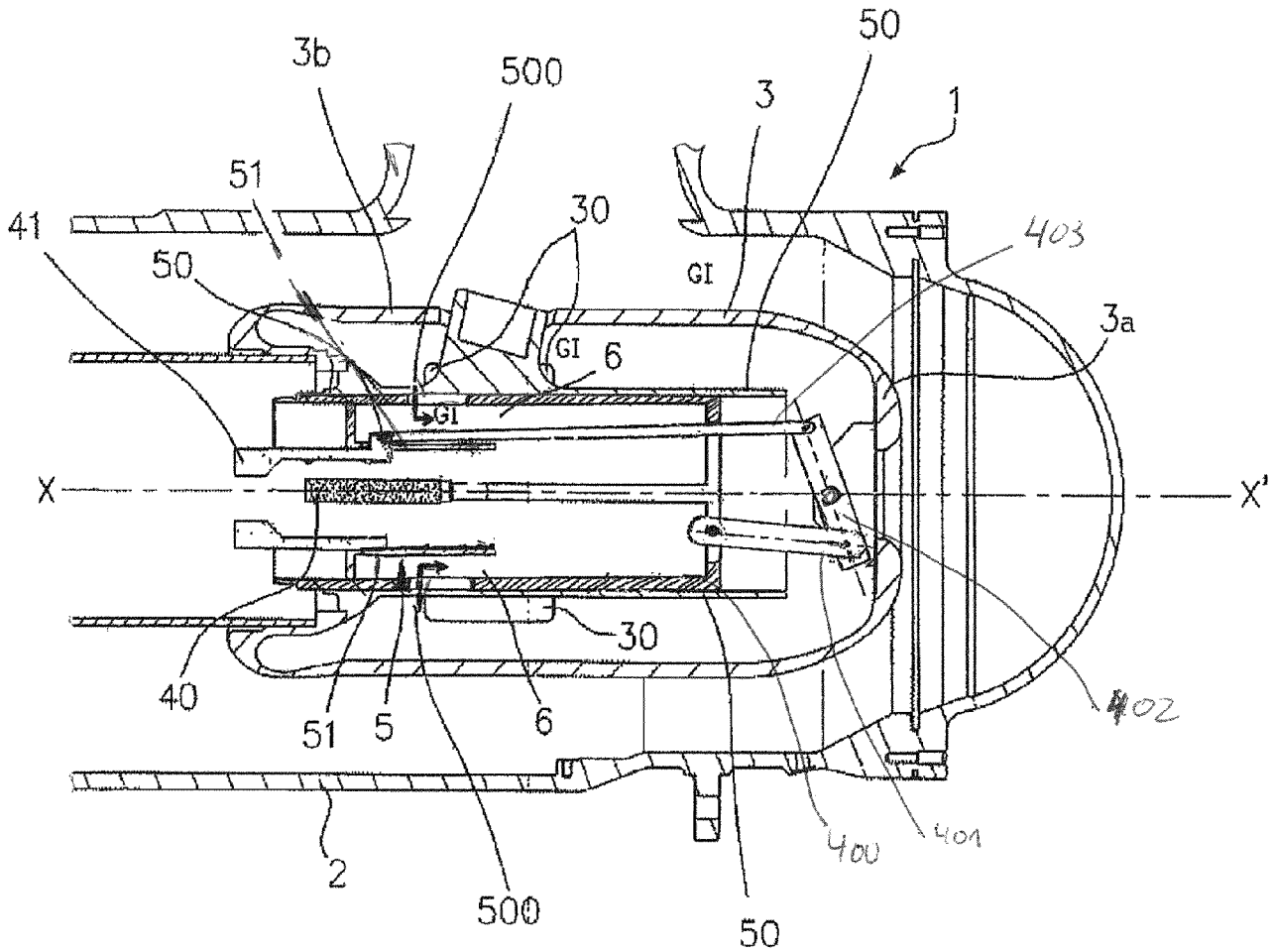
FIG. 4 is a diagrammatic view in longitudinal section showing a circuit breaker in one embodiment of the invention.

Referring to FIG. 4, during a breaking operation of the circuit-breaker 1 according to the invention, the displacement of mutual separation between arcing contacts is given by the another arcing contact (not shown on FIG. 4). This arcing contact is mechanically linked to the nozzle 41. The means for achieving the double movement, i.e, transmission for transmitting the movement to the other arcing contact 40, includes a first connecting rod 401 which is mechanically connected to the nozzle 41; a return lever 402 with two arms, mounted pivoting on the casing 3, and which is coupled to the first connecting rod 401; and, a second connecting rod 403 with one end connected to the return lever and with the other end connected to a tube part 400 of the second arcing contact 40. When the nozzle linked to the first arcing contact (not shown) is moving towards the left, the first connecting rod 401 is also moving towards the left and thanks to the return lever 402, the second connecting rod 403 is moving on the right together with the second arcing contact 40. In other words, both arcing contacts are movable in a straight motion along an axis.

Calculations have shown that the use of the method of the invention in a circuit breaker is effective. In particular, it has been calculated that the static pressure in the interior of the exhaust that guides the hot gases from the insulating nozzle is lower than the pressure prevailing between the exhaust (the casing) and the metal outer tank.

By means of the invention, the length of the exhaust of a high voltage circuit breaker is shortened, which leads to a reduction in the overall length of the associated metal outer tank. This is of particular importance in relation to transport requirements, prior to on-site installation, for "dead tank" outer tanks.

The invention claimed is:

1. A method of evacuating a stream of hot gases produced in a current breaking operation, by a high voltage circuit breaker, which comprises a metal outer tank filled with insulating gas, a casing having gas outlet ports and arranged inside the metal outer tank, said casing delimiting a casing volume having an inside portion in which said stream of hot gases flows when blown out by an insulating nozzle and a peripheral portion around said inside portion, said casing being in communication with said metal outer tank via the ports, wherein cold insulating gas is aspirated from said peripheral portion towards said inside portion, so as to mix the gases inside the casing before they are evacuated, through the gas outlet ports of the casing, into the interior of the metal outer tank.

2. A high voltage circuit breaker comprising:

a metal outer tank filled with an insulating gas;

a casing having gas outlet ports, the casing being arranged inside the metal outer tank, with which it is in communication via the gas outlet ports for the purpose of evacuating gases;

a pair of arcing contacts, at least one of which is movable in straight line motion along an axis and which is fixed to an insulating nozzle for blowing out hot gases generated in the separating of the contacts, said casing delimiting a casing volume having an inside portion in which a stream of said hot gases flows when blown out by said insulating nozzle and a peripheral portion around said inside portion; and means for aspirating the insulating gas from said peripheral portion towards said internal portion, to mix the gases inside the casing before they are evacuated, through the gas outlet ports of the casing, into the interior of the metal outer tank.

3. A circuit breaker according to claim 2, wherein the means for aspirating insulating gas comprises:

a sheath surrounding the fixed contact and arranged inside the casing to define an open passage; and at least one deflector element arranged inside the sheath and being such that the hot gases aspirate the insulating gas from the open passage, with the or each deflector diverting the aspirated insulating gas in a direction parallel to the hot gas flow, and the insulating gas thus aspirated and diverted mixing with the hot gases inside the casing.

4. A circuit breaker according to claim 2, wherein the gas outlet ports are formed either at one longitudinal end or at the other longitudinal end of the casing.

5. A circuit breaker according to claim 3, wherein the open passage has a plurality of holes spaced apart uniformly at the periphery of the sheath.

6. A circuit breaker according to claim 3, having two deflectors which are coaxial on the axis of the straight line motion of the movable contact, one of the two deflectors having at least one notch formed at one of its longitudinal ends, and the casing, sheath and two deflectors together defining a baffle for directing insulating gas through the notch.

7. A circuit breaker according to claim 2, wherein one of the two arcing contacts is fixed to the casing, and the other one is movable in straight line motion along the axis.

8. A circuit breaker according to claim 2, wherein both arcing contacts are movable in straight line motion along an axis.

9. A circuit breaker module according to claim 4, comprising a casing, a sheath and two deflectors made from five metal components which are assembled together and which consist of:

two cast members, of which:

one cast member is a cover member in which the gas outlet ports are formed; and the other cast member comprises a body portion to which the fixed arcing contact can be fixed, and which defines one part of the sheath and one of the two deflectors, the body portion further including a portion in which the insulating nozzle can slide; and three tubular members constituting, respectively, the casing, the remaining part of the sheath, and the other deflector, each of the tubular members being made from rolled metal sheet.

10. A circuit breaker module according to claim 4, comprising a casing, a sheath and two deflectors made from six metal components which are assembled together and which consist of:

three cast members, of which:

one cast member is a cover member in which the gas outlet ports are formed;

a further cast member defines a portion of the sheath and a portion of one of the two deflectors, the further cast member comprising a body portion on which the fixed arcing contact may be secured;

and a final said cast member includes the remaining portion of the one deflector, in which the insulating nozzle is able to slide; and three tubular members constituting, respectively, the casing, the remaining part of the sheath, and the other deflector, each of the tubular members being made from rolled metal sheet.

* * * * *